US010469932B2

(12) United States Patent
Hyatt

(10) Patent No.: US 10,469,932 B2
(45) **Date of Patent: *Nov. 5, 2019**

(54) DUAL MODE HEADPHONES AND METHODS FOR CONSTRUCTING THE SAME

(71) Applicant: APPLE INC., Cupertino, CA (US)

(72) Inventor: Edward Craig Hyatt, West Jordan, UT (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/419,240

(22) Filed: Jan. 30, 2017

(65) Prior Publication Data

US 2017/0142509 A1 May 18, 2017

Related U.S. Application Data

(63) Continuation of application No. 13/098,769, filed on May 2, 2011, now Pat. No. 9,565,490.

(51) Int. Cl.
*H04R 1/10* (2006.01)
*H04R 3/12* (2006.01)
*H04R 29/00* (2006.01)

(52) U.S. Cl.
CPC ..... *H04R 1/1041* (2013.01); *H04R 1/105* (2013.01); *H04R 3/12* (2013.01); *H04R 29/001* (2013.01)

(58) Field of Classification Search
CPC ..... H04R 1/105; H04R 1/1041; H04R 3/12; H04R 29/001

(Continued)

(56) References Cited

U.S. PATENT DOCUMENTS

2008/0166002 A1 7/2008 Amsel
2009/0041267 A1 2/2009 Lee et al.

(Continued)

FOREIGN PATENT DOCUMENTS

CN 200966137 10/2007

OTHER PUBLICATIONS

Greenwald, "iHome's New Headphones Become Speakers." http://bitstream.sounandvisionmag.com/blog/2009/08/ihomes_new head . . . , retrieved Apr. 22, 2011.

(Continued)

*Primary Examiner* — Paul Kim
(74) *Attorney, Agent, or Firm* — Kilpatrick Townsend & Stockton LLP

(57) ABSTRACT

Dual mode headphones, and methods for constructing the same are provided. Headphones can be connected to an electronic device to provide an audio output. The headphones can include a transducer or other component for providing sound waves at appropriate levels near a user's ear. To provide audio as a speaker, however, circuitry in the headphones can include a powered amplifier that may be selectively used. The headphones can be moved between a first, in-ear position and a second, speaker position. A sensor in the headphones can detect the current position of the headphones, and can change the mode of the circuit to correspond to the detected current position. For example, the sensor can change between an in-ear mode in which the amplifier is bypassed and a speaker mode in which the amplifier is powered and used. In some cases, the headphones can include a sensor for preventing the speaker mode when the headphones are positioned near a user's ears.

19 Claims, 8 Drawing Sheets

(58) Field of Classification Search
USPC ..... 381/74
See application file for complete search history.

(56) References Cited

U.S. PATENT DOCUMENTS

| | | | | |
|---|---|---|---|---|
| 2010/0067714 | A1 | 3/2010 | Cheng | |
| 2011/0002478 | A1* | 1/2011 | Pollard | H04R 1/1041 381/74 |

OTHER PUBLICATIONS

Kee, "Zumreed X2 Hybrids Headphones Lets You Tune in in Two Ways." http://ubergizmo.com/2011/02/zumreed-x2-hybrids-headphones-let . . . , retrieved Apr. 22, 2011.

* cited by examiner

DUAL MODE HEADPHONES AND METHODS FOR CONSTRUCTING THE SAME

This application is a continuation of U.S. patent application Ser. No. 13/098,769, filed May 2, 2011 (now U.S. Pat. No. 9,565,490), which is incorporated by reference in its entirety for all purposes.

BACKGROUND

Portable electronic devices have become common place in our society. Users typically listen to content on their portable devices using headphones, although there are speakers available that can be connected to the portable devices to enable multiple users to listen in at the same time. This approach, however, may require a user to carry both a headphone and speakers, or may require the user to rely on speakers built into the device, which may not be as powerful or have as high a sound quality as external speakers.

SUMMARY

Dual mode headphones, and methods for constructing the same, are provided. The headphones can provide an audio output in two different modes of operation based on a user's use of the headphones. In particular, the headphones can provide audio directly to a user's ears in an in-ear mode, and can provide audio as speakers in a speaker mode.

The headphones can include a body providing a structure for the headphones. The body can include a sound port through which sound, generated by a transducer or speaker, can be output. The body can include an articulated or movable component coupled to the sound port, such that the body can be moved from a first position corresponding to a headphone (e.g., an in-ear position) to a second position corresponding to speakers (e.g., a speaker position). In the second position, the headphones can rest as speakers on a surface (e.g., such that the sound ports extend away from the surface to provide better sound output).

Because the headphones may need to provide a louder output in a speaker mode, the headphones can include an amplifier that may be used to amplify audio signals in the speaker mode. The amplifier can be bypassed or turned off in an in-ear mode. The user can enable the speaker mode, and thus make use of the amplifier, using different approaches. For example, a user can press an appropriate button. As another example, the headphones can detect that the body has been positioned in the speaker position, and automatically change to the speaker mode (e.g., change the mode of operation of a circuit of the headphones).

Different approaches can be used to determine the current position of the headphones. For example, the headphones can include a sensor operative to detect the movement or position of an articulated component of the body. Any suitable type of sensor can be used including, for example, a mechanical sensor, a photoresistive sensor, a capacitance sensor, a proximity sensor, an IR sensor, an ambient light sensor, a Hall effect sensor, a resistive sensor, a sensor detecting impedance or voltage changes due to a contact between the headphones and a user, or any suitable combination thereof.

To prevent injury to a user by outputting amplified audio while the headphones are near a user's ears, the headphones can include a sensor for detecting a distance between a user's ears and the headphones. For example, a sensor that detects contact between the headphones and the user can be provided. When the headphones detect that a user's ears are near speakers of the headphones, the headphones can automatically disable the speaker mode and enable the in-ear mode. The headphones can then bypass the amplifier, or reduce the gain of the amplifier to provide an audio output at a lower volume. To conserve resources, a power supply included in headphones for powering the amplifier can be turned off in the in-ear mode.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

An electronic device can include audio output circuitry by which the device can output audio (e.g., provide a sound corresponding to played back media). The audio output circuitry can include an interface by which an external audio component can be connected to the electronic device to convert audio signals provided by the device to audible audio waves.

Figure 1:
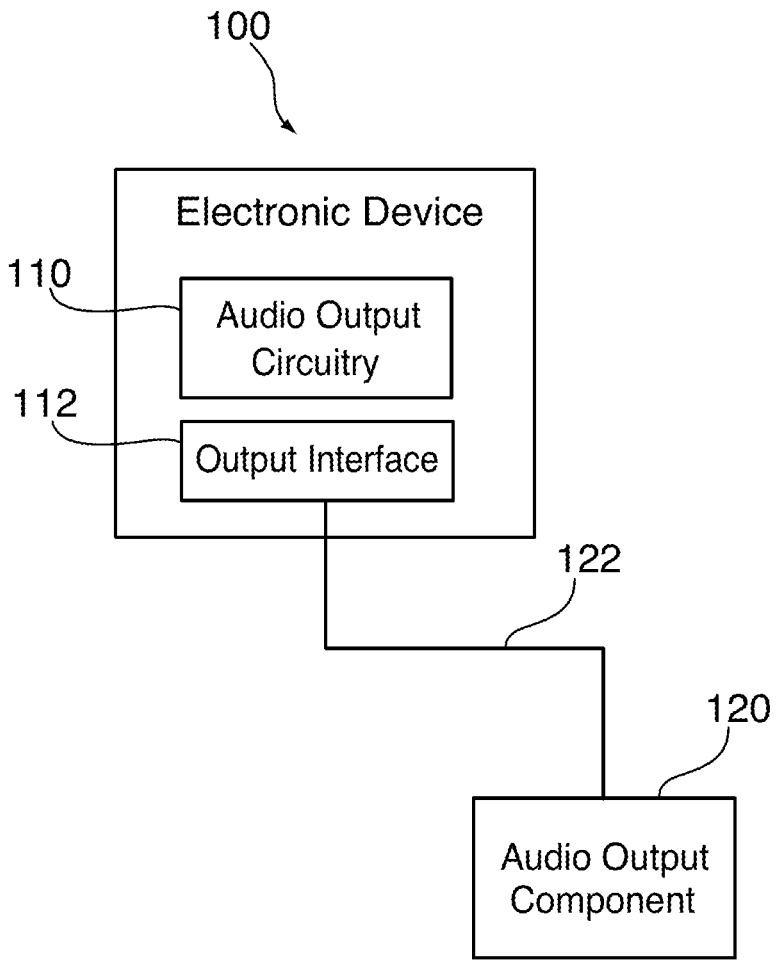
FIG. 1 is a schematic view of an illustrative electronic device having audio output circuitry to which an audio output component is coupled in accordance with some embodiments of the invention.

FIG. 1 is a schematic view of an illustrative electronic device having audio output circuitry to which an audio output component is coupled in accordance with some embodiments of the invention. Device 100 can include audio output circuitry 110 operative to generate a signal corresponding to audio. For example, audio output circuitry 110 can receive information or data corresponding to a particular media item, and can de-multiplex, decode, or otherwise process the data to provide a signal that may be output. The signal generated by audio output circuitry 110 can be provided to output interface 112, for example via one or more conductive paths within device 100.

An audio signal provided to output interface 112 can be in turn transferred to audio output component 120 via path 122. Interface 112 can include, for example, a connector operative to transfer signals. In some embodiments, interface 112 can include one or more of a 3.5 mm audio jack, a 2.5 mm audio jack, a USB connector, a Firewire connector, a 30-pin connector, or any other suitable type of connector. In some cases, interface 112 can include circuitry for wirelessly transmitting signals (e.g., Bluetooth circuitry). Path 122 can include a wired path, a wireless path, or a path that includes both wired and wireless portions. As the audio signal is transferred to audio output component 120, the signal can be converted and output by a speaker as an audible sound. Properties of the audio output (e.g., particular media output, volume, or playback control) can be controlled by device 100, by audio output component 120, or both.

Device 100 can be coupled to any suitable type of audio output component 120. For example, audio output component 120 can include a headphone or ear buds operative to provide audio directly to a user's ears. As another example, audio output component 120 can include powered speakers for providing audio beyond a user's ears. It may be desirable, however, to reduce the number of audio components 120 that a user must carry with him by providing, using a single audio output component 120, audio directly to the user's ears (e.g., an in-ear mode) on the one hand and, audio to a larger region (e.g., a speaker mode) on the other hand. To provide audio to a larger region, however, audio output component 120 may need an embedded powered amplifier to increase the audio output when in speaker mode.

Figure 2:
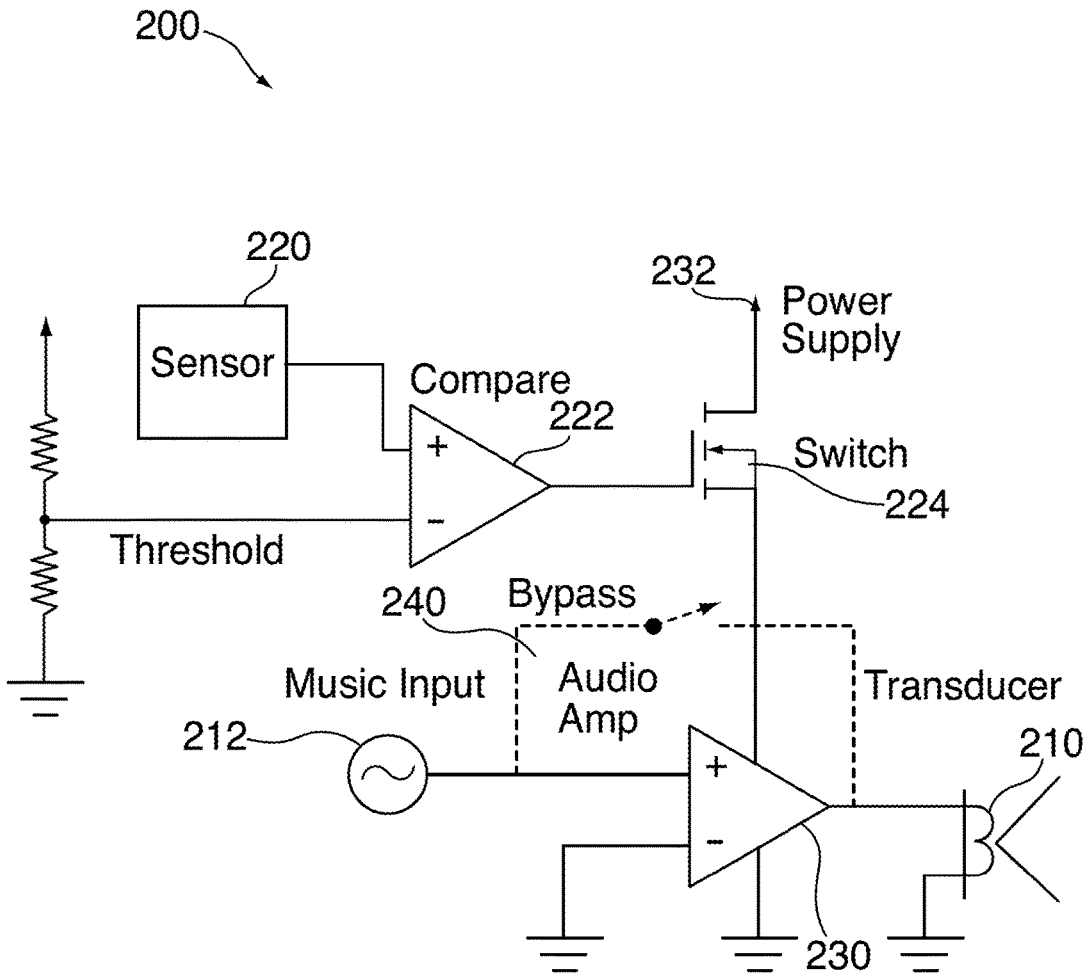
FIG. 2 is a schematic view of an illustrative circuit making use of an amplifier in a speaker mode for an audio output component in accordance with some embodiments of the invention.

FIG. 2 is a schematic view of an illustrative circuit making use of an amplifier in a speaker mode for an audio output component in accordance with some embodiments of the invention. Circuit 200 can include transducer 210 operative to convert audio signals to audible audio (e.g., sound waves). Transducer 210 can receive audio signals from music input 212, which can correspond to an electronic device to which circuit 200 is coupled. For example, circuit 200 can be incorporated in a headphone, which is in turn connected (e.g., via a cable) to an electronic device from which media can be played back.

Circuit 200 can operate in at least two different modes of operation. In a first mode of operation or state, circuit 200 can operate as a headphone by which audio is provided at a limited level, directly into or near a user's ears (e.g., an in-ear mode). In a second mode of operation, circuit 200 can operate as a speaker by which audio is provided, via a powered amplifier at higher levels than in the in-ear mode (e.g., a speaker mode). To switch between modes of operation, circuit 200 can include sensor 220 coupled to amplifier 222. When sensor 220 detects an input that corresponds to a speaker mode, sensor 220 can drive switch 224 to power built in amplifier 230. Audio provided by music input 212 can then be routed through amplifier 230 to transducer 210.

Amplifier 230 can be powered to increase the audio output provided by transducer 210, for example to a level that corresponds to a speaker. Amplifier 230 can receive power from power supply 232, which can include any suitable type of power supply. In some cases, power supply 232 can include batteries (e.g., rechargeable batteries), power from the device providing music input 212, a solar power supply, a mechanical power supply (e.g., flywheels), or any other suitable power supply.

When sensor 220 detects an event that corresponds to an in-ear mode, sensor 220 can drive switch 224 to remove power from amplifier 230. In addition, sensor 220 can bypass amplifier 230 using bypass 240, so that audio from music input 212 goes directly to transducer 210. Alternatively, sensor 220 can reduce the gain provided by amplifier 230.

Figure 3:
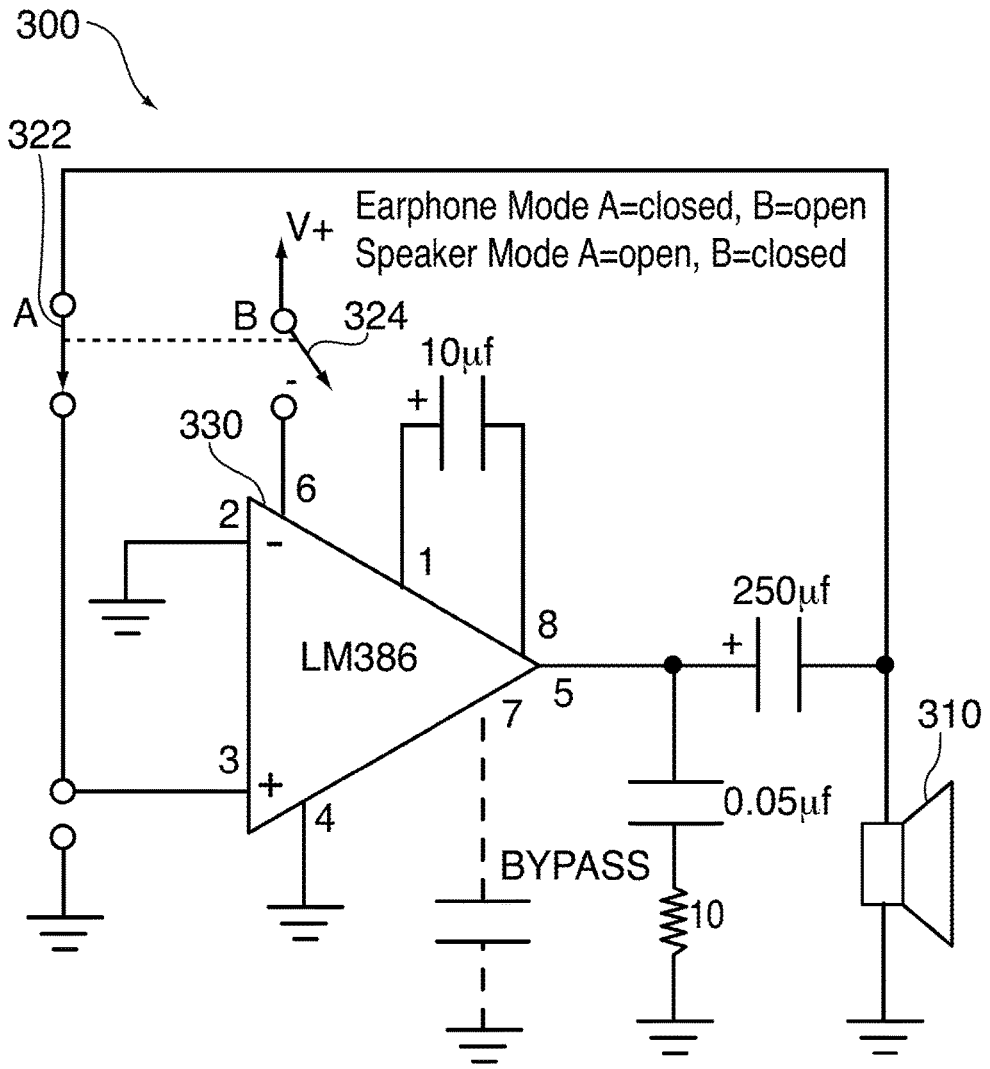
FIG. 3 is a schematic view of an illustrative circuit making use of a LM386 audio amplifier IC in a speaker mode in accordance with some embodiments of the invention.

In some cases, the circuitry used to selectively power and make use of an amplifier can have additional elements, or some elements can be removed. FIG. 3 is a schematic view of an illustrative circuit for making use of a LM386 audio amplifier IC in a speaker mode in accordance with some embodiments of the invention. Circuit 300 can include some or all of the features of circuit 200, described above (FIG. 2). Circuit 300 can include speaker 310 for providing an audio output. Speaker 310 can directly receive an audio signal in an in-ear mode, or can instead receive an audio signal that was amplified by amplifier 330 (e.g., a LM386 audio amplifier IC) in a speaker mode. To selectively power and use amplifier 330, circuit 300 can include switches 322 and 324. When switch 322 is closed and switch 324 is open, amplifier 330 may be bypassed, which corresponds to the in-ear mode. When switch 322 is open and switch 324 is closed, amplifier 330 may be powered and used, which corresponds to the speaker mode.

Although in the examples of FIGS. 2 and 3, an amplifier is provided within the headphones, in some cases the headphones can make use of an amplifier that is not within the headphones. For example, the headphones can direct an audio output to be amplified by an amplifier that is included in an in-line switch of a wired headset. As another example, the headphones can make use of an amplifier of the electronic device. Based on a mode of operation of the headphones, the electronic device can provide audio at a level (e.g., amplified or not) that corresponds to the mode of operation. For example, a user can increase the volume of audio using the electronic device until the volume reaches a maximum corresponding to a headphone mode, and subsequently direct the device to further increase the volume, causing the headphones to switch to the speaker mode and the device to amplify the audio provided to the headphones.

A circuit for selectively using an amplifier in combination with a transducer can be provided in any suitable type of headphone. In particular, the headphones can include a body providing a structure or shape for the headphones, and a circuit providing electronic features (e.g., audio). FIGS. 4A-4D show illustrative headphones in accordance with some embodiments of the invention. Headphone 400, shown in FIG. 4A, can include sound ports 410 and 412 each including a speaker and holes through which audio can be provided to a user. Sound ports 410 and 412 can be connected to each other via band 402. A user can wear headphone 400 by positioning sound ports 410 and 412 over his ears such that band 402 rests against the top of the user's head. In some cases, band 402 can be adjustable to ensure that sound ports 410 and 412 are aligned with the user's ears. Sound ports 410 and 412 can, in some cases, be biased towards each other by band 402 so that the sound ports may press against the user's ears (e.g., to improve sound quality, or to ensure that headphone 400 remains properly positioned on the user's head). Sound ports 410 and 412 can be coupled to band 402 using any suitable approach. In some cases, headphone 400 can include connector 411 coupling sound port 410 to a first end of band 402, and connector 413 connecting sound port 412 to a second end of band 402. Each of connectors 411 and 413 can be articulated to allow sound ports 410 and 412 to move along one or more axes relative to band 402. For example, connectors 411 and 413 can allow sound ports 410 and 412 to rotate around axis 403 extending tangent to an end of band 402, or around axis 404 within a plane perpendicular to axis 403.

Figure 4A:
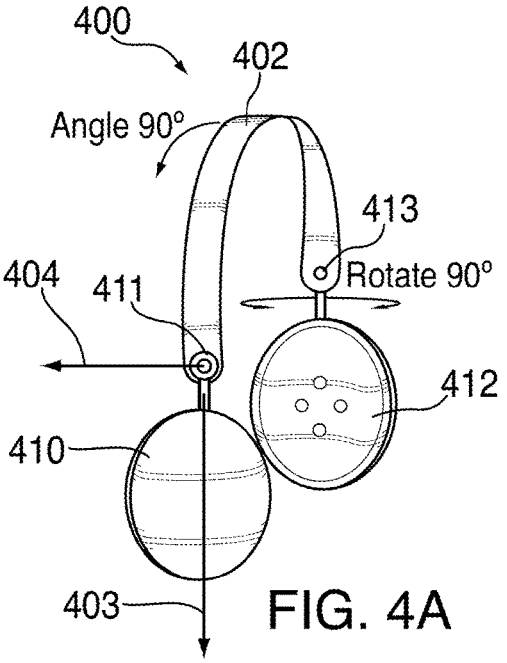
FIGS. 4A-4D show illustrative headphones in accordance with some embodiments of the invention.
Figure 4B:
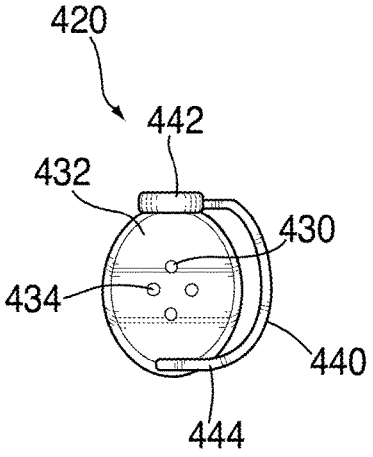

Headphone 420, shown in FIG. 4B, can include an ear clip. In some cases, headphone 420 can include two symmetrical ear clips to be placed around each of a user's ears.

Sound port 430, which can include a speaker and other circuitry for providing an audio output, can include a substantially planar surface 432 operative to be placed adjacent to a user's ear. Planar surface 432 can include openings 434 through which sound generated by a speaker can propagate out of sound port 430. Headphone 420 can include articulated arm 440 coupled to an end of sound port 430. Articulated arm 440 can include a substantially curved shape extending from fixed end 442 coupled to sound port 430 to free end 444. The particular shape of arm 440 can be selected to correspond to a user's ear. In this manner, sound port 430 can be placed against a user's ear, and arm 440 can be positioned behind the user's ear and rotated towards sound port 430 so that a portion of the user's ear is secured between sound port 430 and arm 440.

Figure 4C:
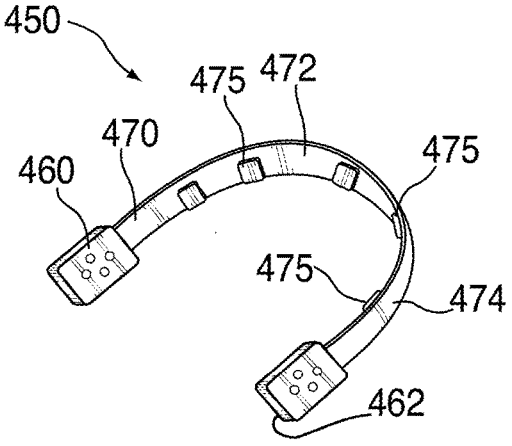

Headphone 450, shown in FIG. 4C, can include a snap band headphone. Headphone 450 can include primary sound ports 460 and 462 positioned on first surface 472 of snap band 470. Sound ports 460 and 462 can include circuitry including at least one speaker, and holes through which audio provided by the speaker may reach the user. Snap band 470 can include a band of material that includes at least two different stable configurations. For example, snap band 470 can be constructed such that it moves elastically to match a first shape in which first surface 472 is on an interior of a curved shape (shown in FIG. 4C), or a second shape in which second surface 474 opposite first surface 472 is on an interior of a curved shape (not shown). Snap band 470 can be selected such that, in one configuration, sound ports 460 and 462 are placed against a user's ears, and snap band 470 extends around a user's head (e.g., around a back of a user's head). Snap band 470 can bias sound ports 460 and 462 towards the user's ears to ensure that headphone 450 remains properly positioned on the user's head. In some cases, headphone 450 can include secondary sound ports 475 disposed on surface 472, which may be selectively enabled based on a mode of operation of the headphone.

Figure 4D:
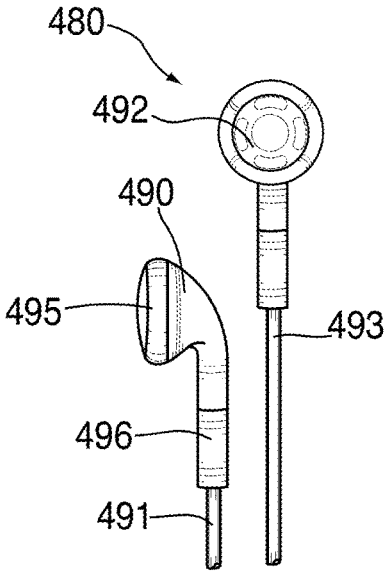

Headphone 480, shown in FIG. 4D, can include in-ear sound ports 490 and 492, each coupled to cables 491 and 493, respectively. Each sound port 490 and 492 can include a mesh through which audio provided by a transducer enclosed within the sound port can reach a user. Sound ports 490 and 492 can be sized to fit in and be retained within a user's ear. Each sound port 490 and 492 can include base structure 495 and stem 496 extending from the base structure, for example to provide an orientation for the headphone (e.g., the stem extends down from the base structure and along and/or around at least a portion of the cable).

In the examples of FIGS. 4A-4D, the headphones are disposed to provide audio directly to a user's ears. In other words, a circuit within the headphones can be in an in-ear mode in which audio provided by an audio source (e.g., an electronic device) is routed directly to a transducer and bypasses an amplifier of the headphones. In some cases, however, the circuit provided in the headphones can in addition be used to provide an amplified audio signal corresponding to a speaker mode. Different approaches can be used to switch between the in-ear mode and the speaker mode of the headphones.

In some cases, the headphones can include a button or other input interface by which a user can enable the speaker mode. Alternatively, an input provided on the electronic device to which the headphones are connected can be used to switch between a speaker mode and a headphone mode (e.g., volume up/down to toggle between modes). In some cases, the headphones can move between a first position in which the circuit is in an in-ear mode (e.g., an in-ear position such as those shown in FIGS. 4A-4D) and a second position in which the circuit is in a speaker mode (e.g., a speaker position). The speaker position can differ from the in-ear position, for example to allow the headphones to stand or rest on a surface. In some cases, the headphones include an articulated component so that the headphones can be moved from the in-ear position to the speaker position.

Figure 5A:
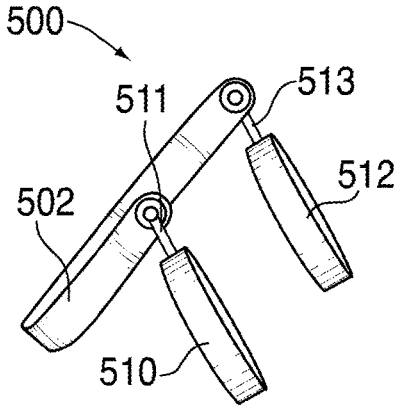
FIGS. 5A-5F show illustrative headphones in speaker positions in accordance with some embodiments of the invention.
Figure 5B:
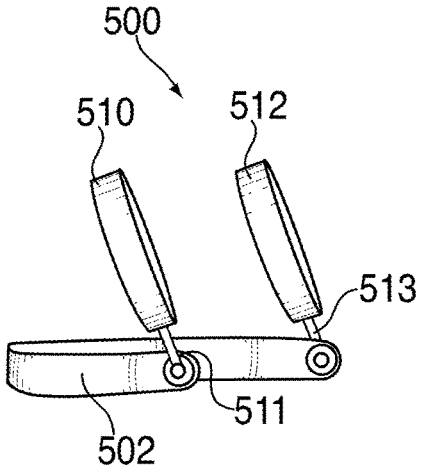

FIGS. 5A-5F show illustrative headphones in speaker positions in accordance with some embodiments of the invention. Headphone 500, shown in FIGS. 5A and 5B, can include some or all of the features of headphone 400 shown in FIG. 4A. In particular, headphone 500 can include sound ports 510 and 512, each coupled to band 502 via connectors 511 and 513, respectively. Connectors 511 and 513 can be articulated such that sounds ports 510 and 512 can move relative to ends of band 502. In particular, sound ports 510 and 512 can be rotated relative to the positions of the sound ports of headphone 400 such that headphone 500 can be disposed to rest on a portion of band 502 as well as on a portion of sound ports 510 and 512 (e.g., as shown in FIG. 5A), or such that headphone 500 can be disposed to rest entirely on band 502 with sound ports 510 and 512 extending away from the surface on which band 502 rests (e.g., as shown in FIG. 5B).

Figure 5C:
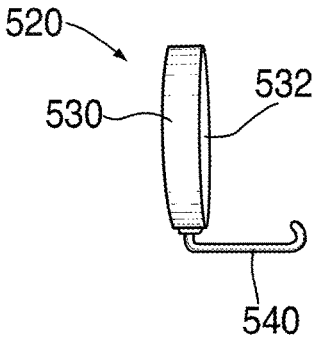
Figure 5D:
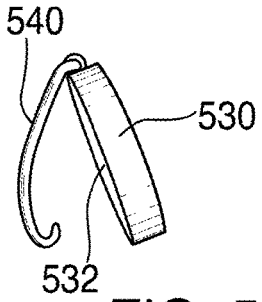

Headphone 520, shown in FIGS. 5C and 5D, can include some or all of the features of headphone 420 (FIG. 4B). For example, headphone 520 can include sound port 530 to which articulated arm 540 is coupled. In contrast with headphone 420, in which an articulated arm is placed adjacent to or in contact with a surface of the sound port, articulated arm 540 can be oriented such that it is away from planar surface 532 (e.g., angled at a large angle relative to planar surface 532). In the example of FIG. 5C, arm 540 may be angled to be substantially perpendicular to planar surface 532 such that headphone 520 can rest on arm 540 with sound port 530 extending from the surface on which arm 540 rests. Alternatively, arm 540 can be angled at a smaller angle relative to planar surface 532 such that headphone 520 can rest in part on arm 540 and in part on sound port 530 such that sound port 530 is angled relative to a surface on which headphone 520 rests.

Figure 5E:
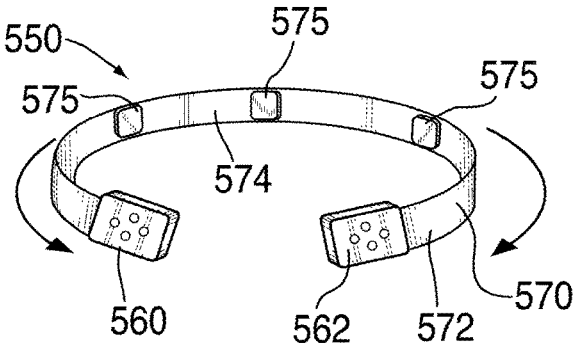

Headphone 550, shown in FIG. 5E, can include some or all of the features of headphone 450 shown in FIG. 4C. In particular, headphone 550 can include primary sound ports 560 and 562 positioned on first surface 572 of snap band 570. To provide audio in a speaker mode, band 570 can be flipped relative to its position in FIG. 4C such that first surface 572 and primary sound ports 560 and 562 are oriented away from each other (e.g., first surface 572 forms an external surface of a loop or curved component). In some cases, headphone 550 can include secondary sound ports 575 disposed on first surface 572 (as shown in FIG. 4C by sound ports 475 on surface 472) and/or on second surface 574 opposite first surface 572 (shown in FIG. 5E) that are actuated when headphone 550 is in the speaker position (e.g., an audio signal is provided to transducers of secondary sound ports 575 only in the speaker mode).

Figure 5F:
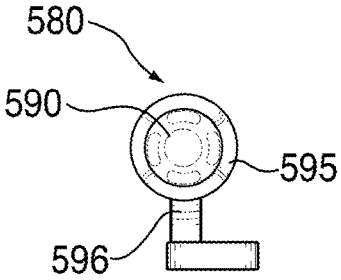

Headphone 580, shown in FIG. 5F, can include some or all of the features of headphone 480 shown in FIG. 4D. In particular, headphone 580 can include sound port 590 having base structure 595 and stem 596. To position headphone 580 in a resting position on a surface, stem 596 can be bent relative to sound port 590 to create several contact points supporting headphone 580.

Different approaches can be used to change the mode of operation of a circuit based on the position of the headphone. In some cases, the headphone can include a sensor operative to detect the current position of the headphone (e.g., in-ear position or speaker position), or to detect a change in position of the headphone (e.g., the movement of an articulated element corresponding to a change in headphone position). Any suitable type of sensor can be used in a headphone in accordance with some embodiments of the invention.

In some cases, the sensor can include a mechanical sensor (e.g., a cam actuation sensor). For example, a sensor can be embedded in a component of the headphones that articulates when the headphones are in the in-ear position or in the speaker position. The mechanical sensor can deflect, move, or rotate by a different amount that may be detected or measured. In this manner, different levels of deflection, movement, or rotation of the sensor can correspond to each of the headphone positions. The device can then, based on the state of the mechanical sensor, enable a particular mode of operation of the headphone circuit (e.g., a first state of the sensor, corresponding to an in-ear position, can correspond to an in-ear mode, and a second state of the sensor, corresponding to a speaker position, can correspond to a speaker mode).

In some cases, the sensor can include a Hall effect sensor. For example, the headphones can include one or more magnets and transducers of a Hall effect sensor disposed within the headphones. In some cases, some or all of the Hall effect sensor components can be provided within an articulated component of the headphones (e.g., a component that moves when the headphones change between in-ear and speaker positions). In some cases, different voltages detected by the Hall effect sensor based on the position of the headphones can be associated with the in-ear and speaker modes of the headphones circuit.

In some cases, the sensor can include a magnetic sensor. For example, the sensor can include several magnets that form part of an electrical circuit. When the headphones are in one of the in-ear position and the speaker position, the magnets can close the electrical circuit and change the mode of operation of the circuit of the headphones.

In some cases, the sensor can include a touch sensor. For example, the sensor can include a capacitance sensor or a resistive sensor that detects different amounts of capacitance or resistance, respectively, based on the position of the headphones. In response to detecting a particular amount of capacitance or resistance, the headphones can determine the current position of the headphones, and can enable a corresponding mode of operation for a circuit (e.g., an in-ear mode or a speaker mode).

In some cases, the sensor can include a proximity sensor. For example, the sensor can detect when a particular component of the headphones (e.g., an arm) is near another component of the headphones (e.g., the components are near each other in one of the in-ear position and the speaker position). Similarly, the sensor can include a IR sensor, ambient light sensor, photo resistive sensor, or other sensor that can be used to detect the relative distance between two components of the headphones. Alternatively, the sensor can be positioned near a transducer of the headphones, where the sensor can detect that the headphones are placed on or in a user's ears (e.g., the sensor can detect light, or the absence of light when ear buds are in a user's ears). In response to detecting the headphone position corresponding to the position of the headphones, the mode of operation of a circuit of the headphones can be changed to an in-ear mode or to a speaker mode (e.g., based on the detected position).

In some cases, the sensor can measure a change in diaphragm impedance due to backpressure when the headphones are put in or on the user's ears. For example, the sensor can average the difference between voltage followers on an input and output of an amplifier, such that when a user puts on the headphones, the back pressure on the diaphragm of the transducer causes the transducer's impedance to drop and the output voltage of the amplifier increases.

In some cases, the sensor can detect changes in resistance due to compression of a headphone component placed over or in a user's ears. For example, the headphones can include an elasto-resistive foam, polymer, or other component whose resistance changes with deformation. In some cases, the component can touch the skin in two places so that the skin can act as one leg of a voltage divider or bridge. In response to detecting a change in resistance, which corresponds to a user placing the headphones on or in his ears, a circuit of the headphones can enable an in-ear mode.

In some cases, the sensor can include a component that senses contact with skin. For example, the sensor can include a metal, conductive polymer, or other conductive component that forms part of an electrical circuit. When the headphones are placed on or in a user's ears, the conductive component can come into contact with the user's skin and close the circuit. In some cases, the conductive component can touch the skin in two places so that the skin can act as one leg of a voltage divider or bridge. In response to detecting that the headphones are in contact with the user's ears, a circuit in the headphones can enable an in-ear mode.

Figure 6:
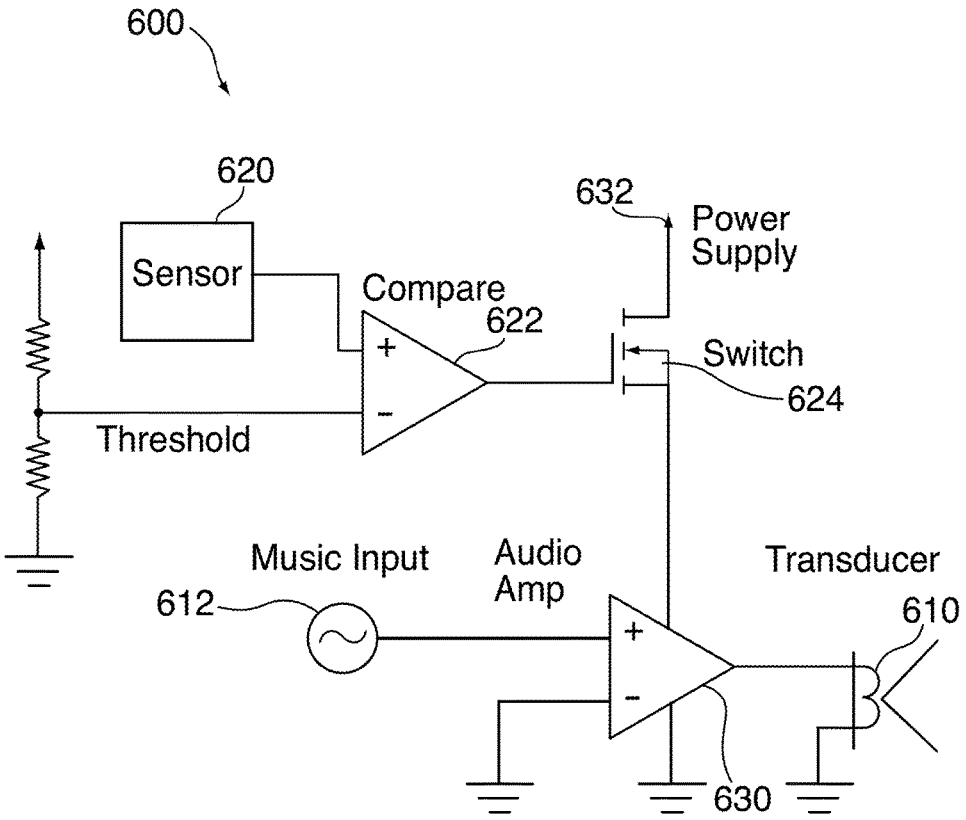
FIG. 6 is a schematic view of an illustrative circuit having a safety sensor for disabling the speaker mode of operation of the circuit in accordance with some embodiments of the invention.

Because the volume of an audio output provided when a circuit is in the speakers mode can be high, and may damage a user's ears if the headphones are placed too close to the user's ears, the headphones can include a safety mechanism by which the headphones can disable the speaker mode when they headphones are placed on or in a user's ears. In some cases, the speaker mode can be automatically re-enabled when the headphones have been moved away from the user's ears. FIG. 6 is a schematic view of an illustrative circuit having a safety sensor for disabling the speaker mode of the circuit in accordance with some embodiments of the invention. Circuit 600 can include some or all of the features of circuit 200, shown in FIG. 2. In particular, circuit 600 can include transducer 610 operative to output audio provided by music source 612. Circuit 600 can include amplifier 630, which can be selectively powered by power source 632, for example in a speaker mode, to provide audio at a higher volume. Power can be selectively provided to amplifier 630 by controlling switch 624.

Circuit 600 can also include sensor 620 operative to combine with amplifier 622 to control the operation of switch 624. In contrast with circuit 200, however, sensor 620 may not operate simply to change the mode of operation of circuit 600. Instead, sensor 620 may operate to determine whether the headphones are placed near a user's ears. For example, sensor 620 can include one or more of the types of sensors described above. The sensor can be tuned to determine the relative position of transducer 610 and the user's ears. When sensor 620 detects that a user's ears are near transducer 610, sensor 620 can direct switch 624 to open and cut power to amplifier 630. Alternatively, sensor 620 can reduce the gain provided by amplifier 630. Circuit 600 can then automatically switch to the in-ear mode and protect a user's hearing.

In some cases, circuit 600 can include a separate different sensor for detecting the position of the headphones to selectively switch between the in-ear mode and the speaker mode. The separate sensor can be used in combination with sensor 620, however, as a safety feature. In some cases, sensor 620 can be designed to simultaneously detect whether the headphones are in an in-ear position or in a speaker position (e.g., to select the mode of operation for the circuit), as well as detect whether transducer 610 is at a safe distance from a user's ears (e.g., to serve as a fail safe for the headphones).

In some cases, the headphones can instead be constructed to simultaneously provide audio in a headphone mode using a primary sound port that is oriented towards a user's ears, and to provide audio in a speaker mode using secondary sound ports that are oriented away from a user's ears. For example, the primary and secondary sound ports can each include speakers on opposite surfaces of an ear bud or ear piece placed in or over a user's ears. In this simultaneous mode, audio provided using the primary sound ports may not be amplified, while audio provided using the secondary sound ports may be amplified by the headphone amplifier. This may allow a user to share audio with others without removing the headphone from his ears.

The simultaneous mode can be enabled using any suitable approach. In some cases, the headphones or device can include a switch or other option that a user may select. In response to receiving the instruction, the headphones can amplify an audio signal provided to a secondary sound port for any suitable duration. For example, the simultaneous mode can be only temporary (e.g., a fixed length of time, or a duration selected based on the audio provided, such as a song length or audiobook chapter), or last until the user changes the headphone mode.

Figure 7:
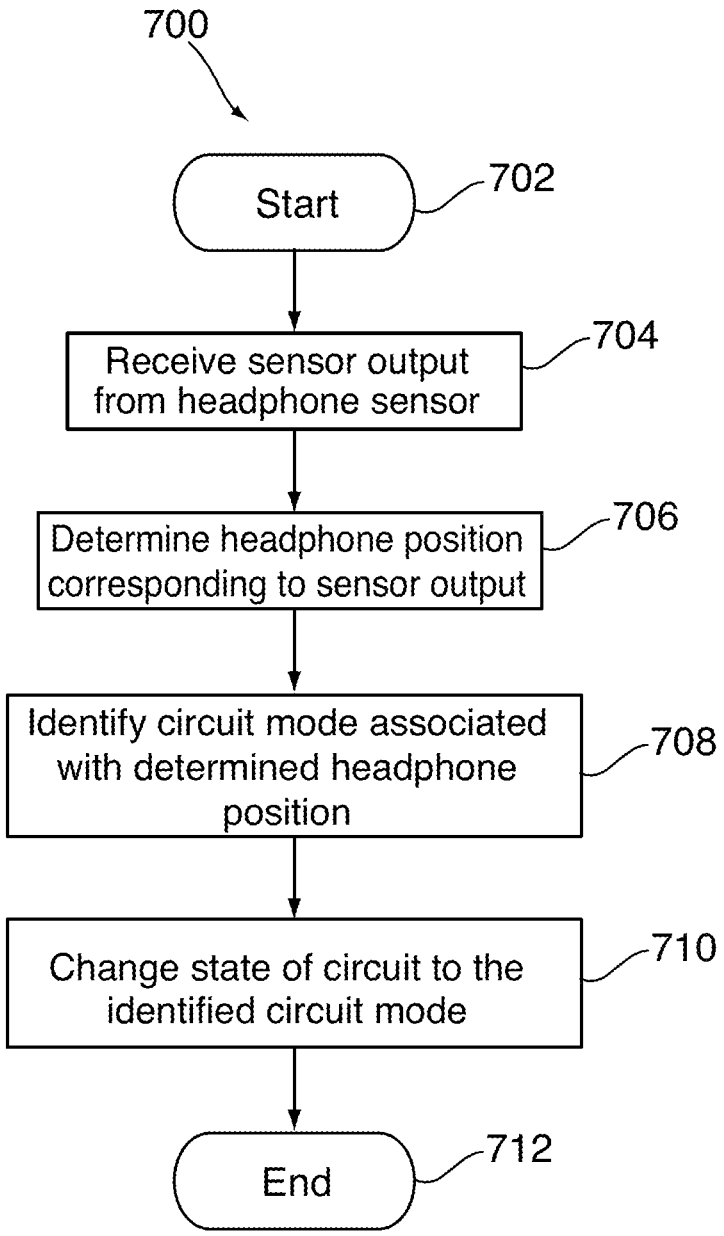
FIG. 7 is a flowchart of an illustrative process for selectively enabling a speaker mode in headphones in accordance with some embodiments of the invention.

The following flowchart illustrates a process used to change a mode of operation of headphones. FIG. 7 is a flowchart of an illustrative process for selectively enabling a speaker mode in headphones in accordance with some embodiments of the invention. Process 700 can begin at step 702. At step 704, a sensor output can be received from a headphone sensor. For example, a headphone sensor can provide an output corresponding to a detected event (e.g., the position of an articulating component of the headphone). At step 706, a headphone position corresponding to the sensor output can be detected. For example, a circuit can determine whether the headphones are in an in-ear position or in a speaker position based on the sensor output. At step 708, the mode of operation of a circuit associated with the determined headphone position can be identified. For example, the determined headphone position can be associated with an in-ear circuit mode or to a speaker circuit mode. The circuit modes of operation can differ, for example, in that the in-ear circuit mode bypasses an amplifier, while the speaker circuit mode makes use of the amplifier. At step 710, the mode of operation of the circuit can be changed to the identified circuit mode of operation. For example, the circuit can change from an in-ear mode to a speaker mode, or vice-versa. Process 700 can then end at step 712.

Figure 8:
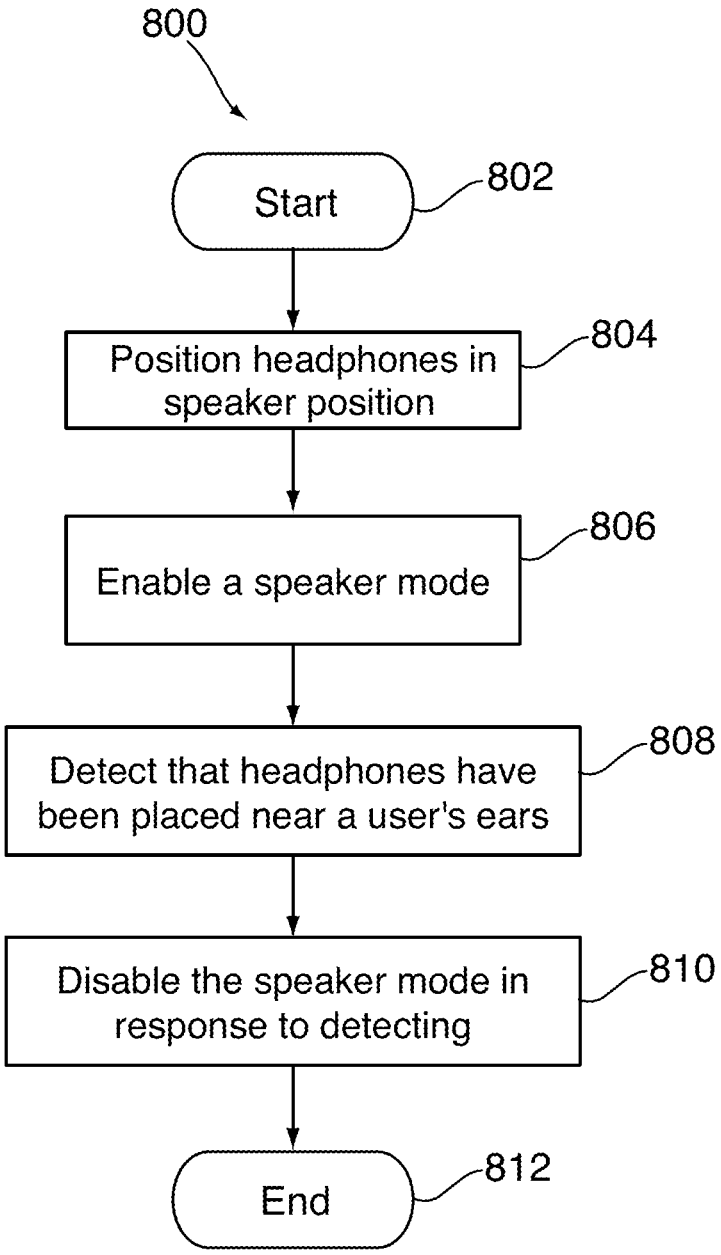
FIG. 8 is a flowchart of an illustrative process for disabling a speaker mode for safety reasons in accordance with some embodiments of the invention.

FIG. 8 is a flowchart of an illustrative process for disabling a speaker mode for safety reasons in accordance with some embodiments of the invention. Process 800 can begin at step 802. At step 804, headphones can be positioned in a speaker position. For example, an articulated component of headphones can be moved to correspond to a speaker position (e.g., moved from a headphone position). At step 806, a speaker mode can be enabled. For example, in response to positioning the headphones in a speaker position, a speaker mode of a circuit in the headphones can be enabled. At step 808, a sensor can detect that headphones have been placed over a user's ears. For example, a sensor positioned near a sound port of the headphones can detect that the sound port is adjacent to a user's ears. At step 810, the speaker mode can be disabled in response to detecting that the headphones have been placed near a user's ears. For example, as a safety feature, the mode of operation of the circuit can automatically be switched from the speaker mode to an in-ear mode. Process 800 can then end at step 812.

The previously described embodiments are presented for purposes of illustration and not of limitation. It is understood that one or more features of an embodiment can be combined with one or more features of another embodiment to provide systems and/or methods without deviating from the spirit and scope of the invention.

What is claimed is:

1. An audio output component comprising:
a body comprising:
a band movable between a first stable configuration and a second stable configuration; and
a sound port coupled to the band; and
a circuit comprising:
a mechanical sensor that measures movement of a portion of the audio output component that articulates when the band transitions between the first stable configuration and the second stable configuration;
a transducer that converts electrical signals into sound that is output through the sound port; and
an amplifier coupled to the sensor and the transducer, wherein the circuit selectively uses the amplifier to amplify the electrical signals based on the measured movement of the portion of the band.

2. The audio output component of claim 1, wherein the circuit is at least partially provided within the body.

3. The audio output component of claim 1, wherein the circuit does one of the following based on the measured movement of the band from the first stable configuration to the second stable configuration:
reduces the gain of the amplifier; or
bypasses the amplifier.

4. The audio output component of claim 3, wherein the circuit does one of the following based on the measured movement of the band from the second stable configuration to the first stable configuration:
increases the gain of the amplifier; or
uses the amplifier to amplify the electrical signals.

5. The audio output component of claim 1, wherein:
the sound port is coupled to an end of the band;
the body further comprises another sound port; and
the other sound port is coupled to another end of the band.

6. The audio output component of claim 5, wherein the circuit further comprises another transducer that converts other electrical signals into other sound that is output through the other sound port.

7. The audio output component of claim 6, wherein:
the sound is output through a first surface of the sound port;
the other sound is output through a first surface of the other sound port; and
when the band is in the first stable configuration, the first surface of the sound port is oriented towards the first surface of the other sound port.

8. The audio output component of claim 7, wherein, when the band is in the second stable configuration, the first surface of the sound port is oriented away from the first surface of the other sound port.

9. The audio output component of claim 5, wherein, when the band is in the first stable configuration, the band is operative to hold the sound port against a first ear of a user and to hold the other sound port against a second ear of the user.

10. The audio component of claim 1, wherein:

the band comprises a first outer surface and a second outer surface;

the first stable configuration comprises a first curved shape;

at least a portion of the first outer surface provides at least a portion of an interior of the first curved shape; and at least a portion of the second outer surface provides at least a portion of an exterior of the first curved shape.

11. The audio component of claim 10, wherein:

the second stable configuration comprises a second curved shape;

the at least a portion of the first outer surface provides at least a portion of an exterior of the second curved shape; and the at least a portion of the second outer surface provides at least a portion of an interior of the second curved shape.

12. The audio component of claim 1, wherein:

the band is operative to move elastically between the first stable configuration and the second stable configuration; and the mechanical sensor is operative to deflect when the band moves elastically.

13. The audio component of claim 1, wherein the mechanical sensor is operative to deflect when the body moves between the first stable configuration and the second stable configuration.

14. The audio component of claim 13, wherein the mechanical sensor comprises a cam actuation sensor that is operative to detect different amounts of deflection of the mechanical sensor.

15. An audio output component comprising:

a body comprising:

a band movable between a first stable position and a second stable position; and a sound port coupled to the band;

a mechanical sensor that measures movement of a portion of the body that articulates when the band moves between the first stable position and the second stable position; and circuitry that outputs sound through the sound port, wherein:

the circuitry outputs the sound through the sound port at a first volume in response to measurements from the mechanical sensor indicating the band is in the first stable position; and the circuitry outputs the sound through the sound port at a second volume that is lower than the first volume in response to measurements from the mechanical sensor indicating the band is in the second stable position.

16. The audio output component of claim 15, wherein:

the sound port is coupled to an end of the band;

the body further comprises another sound port;

the other sound port is coupled to another end of the band;

when the band is in the first stable position, a first surface of the sound port is oriented towards a first surface of the other sound port; and when the band is in the second stable position, the first surface of the sound port is oriented away from the first surface of the other sound port.

17. The audio component of claim 15, wherein:

the band comprises a first surface and a second surface;

when the band is in the first stable position, at least a portion of the band provides a first curved shape;

at least a portion of the first surface provides at least a portion of an interior of the first curved shape;

at least a portion of the second surface provides at least a portion of an exterior of the first curved shape;

when the band is in the second stable position, the at least a portion of the band provides a second curved shape;

the at least a portion of the first surface provides at least a portion of an exterior of the second curved shape; and the at least a portion of the second surface provides at least a portion of an interior of the second curved shape.

18. An audio output component comprising:

a body comprising:

a first sound port;

a second sound port;

a band extending between the first sound port and the second sound port, wherein the band is operative to snap between a first configuration and a second configuration;

a mechanical sensor that measures movement of a portion of the body that articulates when the band moves between the first configuration and the second configuration; and circuitry operative to increase the volume of sound output from at least one of the first sound port and the second sound port in response to measurements from the mechanical sensor indicating the body has snapped from the first configuration to the second configuration.

19. The audio output component of claim 18, wherein:

the first sound port and the second sound port are oriented towards each other when the band is in the first configuration; and the first sound port and the second sound port are oriented away from each other when the band is in the second configuration.

* * * * *